United States Patent [19]

Griffin et al.

[11] Patent Number: 4,869,839

[45] Date of Patent: Sep. 26, 1989

[54] COOLING FLUID FOR FABRICATION OPERATIONS

[76] Inventors: Linnard Griffin, 2409 S. Celia, Cedar Park, Tex. 78613; Darrell Franklin, 7033 Keystone, Corpus Christi, Tex. 78413

[21] Appl. No.: 205,290

[22] Filed: Jun. 10, 1988

[51] Int. Cl.[4] ..... C10M 105/22

[52] U.S. Cl. ..... 252/56 R; 252/52 R

[58] Field of Search ..... 252/32.7 E, 48.2, 52 R, 252/56 R

[56] References Cited

U.S. PATENT DOCUMENTS

| | | | |
|---|---|---|---|
| 4,098,708 | 7/1978 | Stuebe | 252/56 R X |
| 4,132,702 | 1/1979 | Schmitd | 252/56 R X |
| 4,664,822 | 5/1987 | Hunt | 252/56 R X |

*Primary Examiner*—William R. Dixon, Jr.
*Assistant Examiner*—James M. Hunter, Jr.
*Attorney, Agent, or Firm*—Hubbard, Thurman, Turner & Tucker

[57] ABSTRACT

The present invention relates to a cooling fluid for metal cutting, drilling, grinding and other fabricating operations comprising a compound of the formula $C_6H_4(OH)COOR$, where R is selected from the group consisting of —H,—$CH_3$, —$C_2H_5$,—$C_3H_7$, and —$C_4H_9$, a ketone with a boiling point of at least about 150° F., and an at least partially soluble acid.

The present invention also relates to a process and fluid product made by a certain process for cooling tools and workpieces for metal cutting, drilling, grinding and other fabricating operations comprising the steps of mixing a compound of the formula $C_6H_4(OH)COOR$, where R is selected from the group consisting of —H-,—$CH_3$,—$C_2H_5$,—$C_3H_7$, and —$C_4H_9$, a ketone with a boiling point of at least about 150° F., and an at least partially soluble acid, the mixture being a cooling fluid, maintaining substantial contact between the cooling fluid and an amount of transition metal or alloy containing at least one transition metal, sufficient to catalyze a reaction within the fluids during fabrication, and operating a tool while maintaining substantial contact between the tool and the fluid during fabrication.

48 Claims, No Drawings

COOLING FLUID FOR FABRICATION OPERATIONS

BACKGROUND OF THE INVENTION

This invention relates to a cooling fluid for cutting, drilling, grinding, forming, and other fabricating operations where heat removal is desired, particularly for metal cutting and machining processes where the cooling fluid is recycled and used again, although this invention also applies to fabrication operations for glass, as well.

During fabricating operations, an enormous amount of heat is generated at the interface of the tool and workpiece which must be quickly dissipated in order to prevent damage to either the tool, workpiece, or both.

These operations often are characterized by the application of enormous pressures to the workpiece being treated.

Where heat removal is desired, a cooling fluid is often employed to cool the tool. Without a cooling fluid, the cutting tool, for example a bit, becomes very hot due to the pressures applied and the high number of revolutions per minute (RPM), especially at the cutting edge or tip of the tool. This results in overheating and eventually a dull, discolored cutting tool which must be replaced often.

Many fabrication-assisting fluids have been used to cool and lubricate. For example, U.S. Pat. No. 4,218,329 discloses a mixture of a salt of molybdate, two corrosion inhibitors, morpholine, a metal deactivator and a coupling agent.

U.S. Pat. No. 1,423,103 discloses a cooling compound for hot journal boxes consisting of oil, alkali, carbon, and methyl salicylate.

U.S. Pat. No. 3,028,335 discloses a lubricating composition consisting essentially of sodium benzoate, castor oil, mineral oil and triglyceride.

U.S. Pat. No. 3,629,112 discloses an aqueous lubricating and cooling composition consisting essentially of boric acid and a salt of a styrene maleic anhydride copolymer.

A cooling fluid which extends the life of the tool and may be recycled many times and used again, and which cools a tool sufficiently during operation so that the tool can be changed bare-handedly and a different tool inserted in place thereof, is desired. A cooling fluid which enables fabrication operations to proceed at high pressures without resulting in dull cutting tools which must be continuously replaced, which is economical and EPA approved as nontoxic and noncarcinogenic is desired. Also desired is a cooling fluid which may be used regardless of the number of revolutions per minute (RPM's) of the tool being used. Especially desired is a cooling fluid which reacts in such a way so as to dissipate the heat of friction generated between the tool and the workpiece, and which uses the heat to further a reaction which results in further cooling of the tool and workpiece.

SUMMARY OF THE INVENTION

The present invention relates to a cooling fluid for metal cutting, drilling, grinding, forming and other fabricating operations comprising a compound of the formula $C_6H_4(OH)(COOR)$, where R is selected from the group consisting of —H, $—CH_3$, $—C_2H_5$, $—C_3H_7$, and $—C_4H_9$, a ketone with a boiling point of at least about 150° F., and an at least partially soluble acid.

The present invention also relates to a process for cooling tools and workpieces for cutting, drilling, grinding, forming and other fabricating operations comprising the steps of mixing a compound of the formula $C_6H_4(OH)(COOR)$, where R is selected from the group consisting of —H, $—CH_3$, $—C_2H_5$, $—C_3H_7$, and $—C_4H_9$, a ketone with a boiling point of at least about 150° F., and an at least partially soluble acid, the mixture being a cooling fluid, maintaining substantial contact between the cooling fluid and an amount of a transition metal or alloy containing at least one transition metal selected from the group consisting of iron, nickel, aluminum, titanium, cromium, zinc, copper or vanadium, sufficient to catalyze an endothermic reaction during fabrication.

DETAILED DESCRIPTION OF THE INVENTION

The present invention relates to a cooling fluid for cutting, drilling, grinding, forming and other fabricating operations including other manufacturing operations where heat removal is desired, particularly for metal cutting and machining processes where the cooling fluid is recycled and used again, although this invention also applies to fabrication operations for glass, as well. The present invention also relates to a process for cooling tools and workpieces for fabrication operations.

One of the components of the fluid of this invention is a salicylic component which may be salicylic acid $C_6H_4(OH)(COOH)$, or a derivative thereof, $C_6H_4(OH)(COOR)$, where R is selected from the group consisting of —H, $—CH_3$, $—C_2H_5$, $—C_3H_7$, and $—C_4H_9$. For example, the salicylic component of the mixture of this invention may be salicylic acid, $C_6H_4(OH)(COOH)$, methyl salicylate, $C_6H_4(OH)COOCH_3$, $C_6H_4(OH)(COOCH_3)$, ethyl salicylate, $C_6H_4(OH)COOCH_2CH_3$, propyl salicylate, $C_6H_4(OH)COOCH_2CH_2CH_2CH_3$, or butyl salicylate, $C_6H_4(OH)COOCH_2CH_2CH_2CH_3$.

The cooling fluid mixture of this invention comprises a mixture of from about 2% by weight to about 98% by weight, preferably from about 20% by weight to about 40% by weight and most preferably from about 25% by weight to about 35% by weight of the salicylic component.

The second component is a ketone with a boiling point of at least about 150° F. Examples of such ketones are 2-camphanone (camphor), $C_{10}H_{16}O$, 2-butanone (methyl ethyl ketone) $CH_3COCH_2CH_3$, 2-pentanone (methyl propyl ketone) $CH_3(CH_2)_2COCH_3$, 3-methyl-2-butanone (methyl isopropyl ketone) $CH_3COCH(CH_3)_2$, 3-pentanone (diethyl ketone) $C_2H_5COC_2H_5$, 2-hydroxy-2-phenylacetohpenone (benzoin), $C_6H_5CH(OH)COC_6H_5$, and phenyl-2-propanone (phenylacetone) $C_9H_{13}O$. The ketone component percentage may range from about 2% by weight to about 98% by weight, preferably from about 20% by weight to about 80% by weight and most preferably from about 45% by weight to about 65% by weight of the total weight of the cooling fluid mixture.

The acid component of this invention should be a "partially soluble acid". A partially soluble acid is defined as any proton donor compound, organic or inorganic, which is at least partially soluble within the resulting cooling fluid mixture. Thus, examples are methanol, ethanol, propanol, isopropyl alcohol, butanol, acetic acid, hydrochloric acid, and sulphuric acid.

Other acids will be obvious to one of ordinary skill in the art. The alcohols in the above list act as weak acids. Methanol is preferred. Mineral acids and organic acids are considered to be strong acids and smaller amounts of such acids are required in the formulations of this invention as compared to the weak acids. The percent range of acid is from about 0.01% to about 98% by weight preferably from about 5% by weight to about 25% by weight and most preferably from about 10% by weight to about 20% by weight of the total weight of the cooling fluid mixture. As will be appreciated by those skilled in the art, the very low amounts of acid material present will be for the strong acids with greater amounts of the acid material being utilized for the weak acid materials.

The cooling fluids of this invention preferably comprise a mixture of the salicylic component with the ketone in a percent by weight ratio of from about 0.25:1 to about 2:1, preferably from about 0.5:1 to about 1.5:1, and most preferably about 1:1. The acid component can vary from a very small amount in the case of a strong acid up to large amounts as previously mentioned for weak acids.

Any of the three necessary components of this invention (the salicylic component, the ketone component or the at least partially soluble acid component) may be in excess of these percent by weight ranges and function as a diluent for the other components. Thus the percent ranges of the salicylic component, the ketone component and the at least partially soluble acid component are broad to account for the use of any of the three components as a diluent.

Optionally, a surface tension reducing agent may be added to the mixture. One example of a surface tension reducing agent, although certainly not exhaustive of all surface tension reducing agents that could be used, is turpentine, $C_{10}H_{16}$. Turpentine also acts as a lubricating agent and helps prevent and inhibit corrosion of the metals of the tools and workpieces. This agent also facilitates the ease of fabrication of the workpiece by the tool. Other examples of surface tension reducing agents which may be employed are naphtha cyclohexane, hexane, heptane, diesel fuel. The surface tension reducing agent is not required in this invention; however, its use results in even greater efficiency of the cooling fluid. The surface tension reducing agent may be added in any amount but is preferably added in the amount of from about 5% by weight to about 15% by weight.

The components are mixed to yield the cooling fluid of this invention. The fluid is then maintained in substantial contact between an amount of a transition metal or alloy containing at least one transition metal sufficient to catalyze a reaction with the fluid during fabrication.

Typically, a transition metal selected from the group consisting of iron, nickel, aluminum, titanium, cromium, zinc, copper or vanadium is incorporated within the tool and/or workpiece, and is most usually incorporated within the cutting tool in metal cutting, drilling, grinding and other fabricating operations. Oftentimes, the cutting tool is a bit which is applied to the workpiece (the piece of metal which is being cut, drilled, ground, etc.) with intense pressures, resulting in high heats of friction. Often times, the contact between the cutting tool and the workpiece is on the order of many minutes or hours at a time. Thus, the cooling fluid can be maintained in substantial contact with the transition metal by either incorporating a transition metal within the cutting tool and/or workpiece, or by adding a sufficient amount of a transition metal complex such as an iron complex to the mixture to catalyze the reaction. An alloy containing a sufficient amount of one or more of these transition metals combined with some other non-transition metal may be used.

The tool is operated while substantial contact between the tool and the fluid is maintained during fabrication of the workpiece. Typically, the cooling fluid flows down the sides of the tool, preferably a cutting tool and most preferably a bit, so that it contacts the tip of the tool or bit during fabrication. Normally the cooling fluid is delivered through a tube or other conduit means to the cutting tool and is allowed to merely flow down the sides of the cutting tool to a location where the cutting tool contacts the workpiece. Also, some tools are hollowed to allow injection of the fluid through the center of the tool to the tip of the tool. Any number of methods of application of the cooling fluid to the cutting tool will be apparent to one of ordinary skill in the art.

The cooling fluids of this invention exhibit rather remarkable and unusual properties compared to other known cooling fluids. Specifically there appears to be some type of an endothermic phenomena exhibited by the cooling fluid when it is in contact with the cutting tool and the workpiece whereby an unexpected cooling occurs. For purposes of this specification it is theorized that there is an endothermic reaction between the various components of the cooling fluid that unexpectedly cool the cutting tool and/or the workpiece.

The endothermic chemical reaction that is believed to be taking place is outlined below for one particular combination of components: methyl salicylate, camphor and methanol.

Chemical Reaction

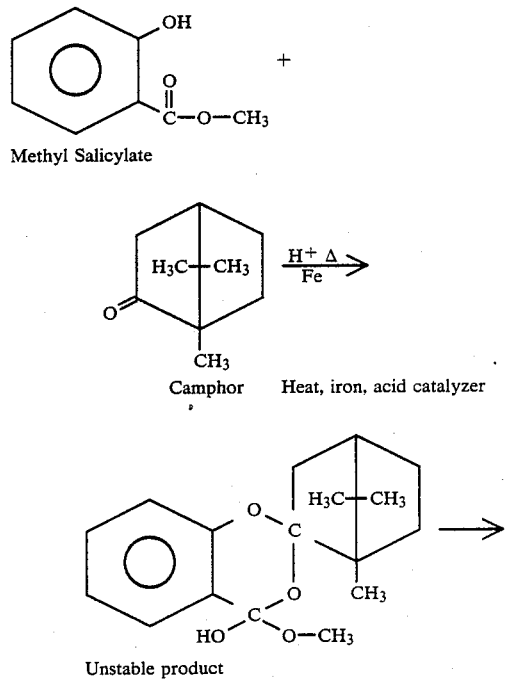

-continued

Chemical Reaction

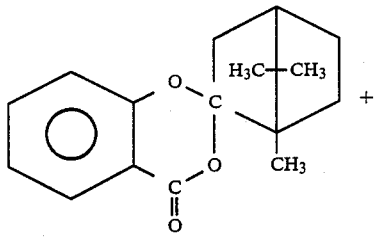

CH3OH (Methanol) ⟶ Spiro [bornane-2,2'-4'-lacto-1',3'-dioxanapthlene]

As the heat of friction between the tool and the workpiece increases, the methyl salicylate and camphor of the cooling fluid, in combination with the iron and methanol, produce an unstable product which then, somewhere between 140° F. and 250° F., vaporizes at least some of the methanol and produces a stable compound with a high boiling point which remains in the liquid state—spiro[bornane-2, 2'-4'-lacto-1',3', dioxanapthalene]. The constant heat of friction supplies the energy and heat necessary in order for the reaction to form the spiro compound. The heat build-up occurs primary at the cutting tip of the bit. As the heat increases, and the mixture contacts the heated tool and/or workpiece the reaction occurs. Sensible heat from the friction between the tool and the workpiece is absorbed or taken up by the resulting endothermic reaction. If the initiate the reaction and thus more reaction occurs, which thereby results in more heat absorbed and thus an overall temperature limitation as a result of the cooling effect.

Since the evaporation of methanol uses energy, the evaporation provides some of the cooling effect as does "flooding" of the tool with the fluid. However, the substantive cooling effect of this reaction, and indeed, the ability of the tool to sometimes withstand two or more times the pressure that can usually be withstood with use of other cooling fluids can be attributed to the unique occurrence of an endothermic reaction where heat from the heat of friction between the tool and workpiece serves to catalyze a reaction between the fluid and the transition metal. The additional heat that is produced results in more heat being available for use to further the reaction and to produce the spiro compound and methanol vapor, which then results in unexpected cooling of the tool and/or workpiece above and beyond the cooling that takes place from the ordinary cooling mechanisms and heat transfer principles of flooding a hot item with a cold fluid.

After fabrication, the cooling fluid runoff can be collected and recycled because only a very small portion of each of the original components of the fluid, mixture are necessary for the reaction and thus, the fluid may be reused many times before being replaced. As the cooling fluid is recycled and reused, the active components of the cooling fluids of this invention will react and it will be necessary to either replace the cooling fluid with new fluid or to replace components of the cooling fluid that are "used up".

The fluid of this invention, may, of course, contain other types of compounds such as bacteriacides, fungiacide compounds, conventional lubricating materials such as oils and the like, or chelating agents. Other compatible fluids may also be incorporated into this cooling fluid, as well.

A series of runs was carried out whereby the liquid formulated is tested as a cooling fluid to demonstrate the unexpected results of the instant invention. The results of each of the runs are reported in Table 1, following run 11.

EXPERIMENT 1

50% by weight methyl salicylate, and 50% by weight camphor were mixed. About ¼ gm. of steel wool was added to the mixture.

EXPERIMENT 2

40% by weight methyl salicylate, 40% by weight camphor and 20% by weight methanol mixed. About one ¼ gm. of steel wool was added to the mixture.

EXPERIMENT 3

A mixture of 2% by weight methyl salicylate, 45% by weight camphor, 22% by weight turpentine, and 11% by weight acid was prepared with eight drops of iron complex.

EXPERIMENT 4

A mixture of 30% by weight methyl salicylate, 55% by weight camphor, and 15% by weight acid was prepared.

EXPERIMENT 5

A mixture of 25% by weight methyl salicylate, 50% by weight camphor, and 25% by weight turpentine was prepared.

EXPERIMENT 6

A mixture of 33% by weight methyl salicylate and 67% by weight camphor was prepared.

EXPERIMENT 7

The mixture of EXPERIMENT 6 was prepared and 0.5% by weight of 37% hydrocholoric acid was added to the mixture.

EXPERIMENT 8

The mixture of EXPERIMENT 6 was prepared, including the hydrochloric acid and 1% by weight turpentine sufficient to lubricate and inhibit corrosion of the workpiece was added.

EXPERIMENT 9

A mixture of 50% by weight methyl salicylate, 49.5% by weight camphor and 0.5% by weight sulphuric acid was prepared.

EXPERIMENT 10

A mixture of 40% by weight methyl salicylate, 40% by weight camphor, and 20% by weight methanol was prepared except that an exotic metal was used as the workpiece.

EXPERIMENT 11

A steel bit was used to drill through a ½ in. stainless steel workpiece. The drill bit was flooded with drilling fluid of EXPERIMENTS 1–10 and then the drill was stopped suddenly and quickly withdrawn. In each case the bit was felt with a barehand and it was cool to the touch. The heat build up during drilling was evaluated as either excessive or minimal and the pressure required to complete drilling was evaluated as high or low. The results are shown in Table 1.

The following chart illustrates the results of EXPERIMENTS 1–10 which were tested in accordance with EXPERIMENT 11.

TABLE 1

| Experiment Number | % by weight $S^1:K^2:T^3:A^4$ Transition Metal | Drilling Results of Cooling Fluid Ratios of the Present Invention: Heat Build Up During Drilling (E = Excessive) (M = Minimal) | Pressure Req'd. to Complete Drilling (H = High) (L = Low) | Temperature of Bit | Fluid Acceptable or Unacceptable (A or U) |
|---|---|---|---|---|---|
| 1 | 50:50:0:0: steel wool | E | H | Hot | U |
| 2 | 40:40:0:20 (methanol) steel wool | M | L | Cool | A |
| 3 | 22:45:22:11 (methanol) iron | M | L | Cool | A |
| 4 | 30:55:0:15 (methanol) iron | M | L | Cool to Lukewarm | A |
| 5 | 25:50:25:0 iron | E | H | Hot | U |
| 6 | 33:67:0:0 iron | E | H | Hot | U |
| 7 | 33:67:0:0.5 (HCl) iron | M | L | Cool to Lukewarm | A |
| 8 | 33:66:1:0.5 (HCl) iron | M | L | Cool | A |
| 9 | 50:49.5:0:0.5 ($H_2SO_4$) iron | M | L | Cool | A |
| 10 | 40:40:0:20 ($H_2SO_4$) (methanol) iron | M | L | Cool | A |

[1]S = Salicylic component
[2]K = Ketone with boiling point of at least about 150° F.
[3]T = Surface tension reducing agent
[4]A = At least partially soluble acid
[5]The tip of the bit was felt bare-handedly immediately after drilling was completed.

As may be seen from Table 1, the fluid mixtures which contained no acid (EXPERIMENT Nos. 1, 5 and 6) resulted in excessive heat build-up during fabrication, a need for very high pressures in order to complete the drilling, and a drill bit that was hot to the touch and therefore would require excessive cooling before it could be handled. Thus, these fluids were unacceptable. Even very small amounts of acid (see EXPERIMENTS 7–9) were sufficient to catalyze an endothermic reaction and produce an acceptable cooling fluid. Even a weak acid such as methanol was sufficient to contribute to the reaction (see EXPERIMENT Nos. 2, 3 and 4). The acid component may also be a high ratio with regard to the salicylic and ketone components.

While EXPERIMENTS 1–10 used ratios of salicylic component to ketone component of at least 1:1, these ratios can vary from about 15% by weight to about 66% by weight salicylic component, where R is —H, —$CH_3$, —$C_2H_5$, —$C_3H_7$ or —$C_4C_9$, and from about 20% by weight to about 75% by weight of ketone component with a boiling point of at least about 150° F. Extra salicylic component, ketone or acid may be used as a diluent up to 65% by weight of the total mixture weight.

EXPERIMENT 12

Cooling fluid was prepared in accordance with EXPERIMENT 2 and mixed with WD40 diluent to result in sample solutions of 10%, 20%, 30%, 40%, 50%, 60%, 70%, 80%, and 90% cooling fluid of this invention. One sample was 100% cooling fluid of this invention. Each solution was used with a ¼ in. carbide drill on an aluminum/silica/short fiber carbide metal workpiece that had been successfully drilled previously only with diamond tooling due to of the heat generated. (The aluminum/silica/short fiber carbide metal is referred to as an exotic metal.)

The results are illustrated in Table II below:

TABLE II

Drilling Results of Various Cooling Fluids Using a Carbide Drill Bit on an Aluminum/Silica/Short Fiber Carbide Workpiece

| % Standard Cooling Fluid* | % Cooling Fluid of This Invention | % Diluent | Drilling Accomplished |
|---|---|---|---|
| 0 | 10 | 90 | ½ workpiece thickness |
| 0 | 20 | 80 | 1 hole in workpiece |
| 0 | 30 | 70 | 1½ holes in workpiece |
| 0 | 40 | 60 | 2 holes in workpiece |
| 0 | 50 | 50 | 2½ holes in workpiece |
| 0 | 60 | 40 | 3 holes in workpiece |
| 0 | 70 | 30 | 3½ holes in workpiece |
| 0 | 80 | 20 | 4 holes in workpiece |
| 0 | 90 | 10 | 5 holes in workpiece |
| 0 | 100 | 0 | 6 holes in workpiece |
| 100 | 0 | 0 | None-could not get a hole started-diamond |

TABLE II-continued

Drilling Results of Various Cooling Fluids Using a Carbide Drill Bit on an Aluminum/Silica/Short Fiber Carbide Workpiece

| % Standard Cooling Fluid* | % Cooling Fluid of This Invention | % Diluent | Drilling Accomplished |
|---|---|---|---|
| | | | tooling required |

*Bowlube or Aculube

As may be seen in Table II, an exotic metal workpiece could not be drilled using a standard cooling fluid of Bowlube or Aculube and a carbide drill bit, but required the use of diamond tooling instead.

Even a 10% solution of the cooling fluid of the present invention and diluent or solvent such as WD-40, enabled the workpiece to be partially drilled. The greater the percentage of cooling fluid, the better the drilling results. Even 100% strength of the standard cooling fluid did not result in drilling substantial enough to even get a hole started.

The presence of a surface tension reducing agent is not required as is illustrated from the acceptable results in EXPERIMENT Nos. 4, 7, 9 and 10. The surface tension reducing agent component may be a lower or higher ratio with regard to the salicylic and ketone components.

It is understood that the drilling fluids of this invention may include other materials such as diluents or solvents which are miscible with all of the components of the cooling fluid. Standard lubricating agents such as WD-40 may be used or the salicylic component, ketone component, or the at least partially soluble acid component of this invention may be used. The diluent is optional but may comprise as much as about 65% by weight of the total mixture.

The foregoing examples have served to illustrate only a few combinations and ratios of components which may be used to produce the cooling fluid and carry out the process of this invention. Other modifications will become apparent to one of ordinary skill in the art.

What is claimed is:

1. A cooling fluid for cutting, drilling, grinding and other fabricating operations comprising:

from about 2% by weight to about 98% by weight of a compound of the formula $C_6H_4(OH)COOR$, where R is selected from the group consisting of —H, $—CH_3$, $—C_2H_5$, $—C_3H_7$, and $—C_4H_9$;

from about 2% by weight to about 98% by weight of a ketone with a boiling point of at least about 150° F.; and from about 0.01% by weight to about 98% by weight of an at least partially soluble acid.

2. The fluid of claim 1, wherein said compound of the formula $C_6H_4(OH)COOR$, is methyl salicylate.

3. The fluid of claim 1, wherein said acid is selected from the group consisting of methanol, ethanol, propanol, isopropyl alcohol, butanol, acetic acid, hydrochloric acid and sulfuric acid.

4. The fluid of claim 1, wherein said acid is methanol.

5. The fluid of claim 1, which additionally includes a diluent.

6. The fluid of claim 1, which additionally comprises a surface tension reducing agent.

7. The fluid of claim 6, wherein said surface tension reducing agent comprises from about 5% by weight to about 15% by weight of the total percent weight of said fluid.

8. The fluid of claim 6, wherein said surface tension reducing agent is turpentine.

9. A cooling fluid for cutting, drilling, grinding and other fabricating operations comprising:

from about 20% by weight to about 40% by weight of a compound of the formula $C_6H_4(OH)COOR$, where R is selected from the group consisting of —H, $—CH_3$, $—C_2H_5$, $—C_3H_7$, and $—C_4H_9$;

from about 20% by weight to about 80% by weight of a ketone with a boiling point of at least about 150° F.; and from about 5% by weight to about 25% by weight of an at least partially soluble acid.

10. The fluid of claim 9, wherein said compound of the formula $C_6H_4(OH)COOR$ is methyl salicylate.

11. The fluid of claim 9, wherein said acid is selected from the group consisting of methanol, ethanol, propanol, isopropyl alcohol, butanol, acetic acid, hydrochloric acid and sulfuric acid.

12. The fluid of claim 9, wherein said acid is methanol.

13. The fluid of claim 9, which additionally includes a diluent.

14. The fluid of claim 9, which additionally comprises a surface tension reducing agent

15. The fluid of claim 11, wherein said surface tension reducing agent comprises from about 5% by weight to about 15% by weight of the total percent weight of said fluid.

16. The fluid of claim 14, where said surface tension reducing agent is turpentine.

17. A cooling fluid for cutting, drilling, grinding and other fabricating operations, comprising:

from about 25% by weight to about 35% by weight of a compound of the formula $C_6H_4(OH)COOR$, where R is selected from the group consisting of —H, $—CH_3$, $—C_2H_5$, $—C_3H_7$, and $—C_4H_9$;

from about 45% by weight to about 65% by weight of a ketone selected from the group consisting of camphor, methyl ethyl ketone, methyl propyl ketone, methyl isopropyl ketone, diethyl ketone, benzoin and phenylacetophenone; and from about 10% by weight to about 20% by weight of an at least partially soluble acid selected from the group consisting of methanol, ethanol, propanol, isopropyl alcohol and butanol.

18. The fluid of claim 17, wherein said compound of the formula $C_6H_4(OH)COOR$ is methyl salicylate.

19. The fluid of claim 17, wherein said acid is methanol.

20. The fluid of claim 17, which additionally includes a diluent.

21. The fluid of claim 17, which additionally comprises from about 5% by weight to about 15% by weight of a surface tension reducing agent.

22. The fluid of claim 21, where said surface tension reducing agent is turpentine.

23. A cooling fluid for cutting drilling, grinding and other fabricating operations, comprising:

from about 25% by weight to about 35% by weight of of methyl salicylate;

from about 45% by weight to about 65% by weight camphor; and from about 10% by weight to about 20% by weight methanol.

24. The fluid of claim 23, which additionally includes a diluent.

25. The fluid of claim 23, which additionally comprises from about 5% by weight to about 15% by weight of a surface tension reducing agent.

26. A cooling fluid for cutting, drilling, grinding and other fabricating operations, comprising:

from about 25% by weight to about 35% by weight of methyl salicylate;

from about 45% by weight to about 65% by weight camphor;

from about 10% by weight to about 20% by weight methanol; and from about 5% by weight to about 15% by weight turpentine.

27. The fluid of claim 26, which additionally includes a diluent.

28. A cooling fluid for cutting, drilling, grinding and other fabricating operations made by the process comprising the step of:

mixing from about 25% by weight to about 35% by weight of methyl salicylate; from about 45% by weight to about 65% by weight of camphor; from about 10% by weight to about 20% by weight methanol; and from about 5% by weight to about 15% by weight turpentine.

29. A process for cooling tools and workpieces for cutting, drilling, grinding and other fabricating operations comprising the steps of:

mixing a compound of the formula $C_6H_4(OH)COOR$, where R is selected from the group consisting of —H, —$CH_3$, —$C_2H_5$, —$C_3H_7$, and —$C_4H_9$, a ketone with a boiling point of at least about 150° F., and an at least partially soluble acid, said mixture being a cooling fluid;

maintaining substantial contact between said cooling fluid and an amount of a transition metal or alloy containing at least one transition metal, sufficient to catalyze an endothermic reaction with said fluid during fabrication; and operating a fabrication tool while maintaining substantial contact between said fabrication tool and said fluid during fabrication.

30. The process of claim 29, wherein a diluent is additionally mixed in said cooling fluid.

31. The process of claim 29, wherein a surface tension reducing agent is additionally mixed in said cooling fluid.

32. The process of claim 29, wherein said fabrication tool contains said transition metal or said alloy.

33. The process of claim 29, wherein said workpiece contains said transition metal or said alloy.

34. A process for cooling tools and workpieces for cutting, drilling, grinding and other fabricating operations comprising the steps of:

mixing from about 2% by weight to about 98% by weight of a compound of the formula $C_6H_4(OH)$-COOR, where R is selected from the group consisting of —H, —$CH_3$, —$C_2H_5$, —$C_3H_7$, and —$C_4H_9$, from about 2% by weight to about 98% by weight of a ketone with a boiling point of at least about 150° F. and from about 0.01% by weight to about 99% by weight of an at least partially soluble acid, said mixture being a cooling fluid;

maintaining substantial contact between said cooling fluid and an amount of a transition metal or alloy containing at least one transition metal, sufficient to catalyze a reaction within said fluid during fabrication; and operating a fabrication tool while maintaining substantial contact between said tool and said fluid during fabrication.

35. The process of claim 34, wherein a diluent is additionally mixed in said cooling fluid.

36. The process of claim 34, wherein a surface tension reducing agent is additionally mixed in said cooling fluid.

37. The process of claim 34, where said fabrication tool contains said transition metal or said alloy.

38. The process of claim 34, where said workpiece contains said transition metal or said alloy.

39. A process for cooling cutting tools and workpieces for metal cutting operations comprising the steps of:

mixing from about 20% by weight to about 40% by weighto f a compound of the formula $C_6H_4(OH)$-COOR, where R is selected from the group consisting of —H, —$CH_3$, —$C_2H_5$, —$C_3H_7$, and —$C_4H_9$, from about 20% by weight to about 80% by weight of a ketone with a boiling point of at least about 150° F. and from about 5% by weight to about 25% by weight of an at least partially soluble acid, said mixture being a cooling fluid;

maintaining substantial contact between said cooling fluid and an amount of a transition metal or alloy containing at least one transition metal, sufficient to catalyze a reaction within said fluid during cutting; and operating a cutting tool while maintaining substantial contact between said cutting tool and said fluid during cutting.

40. The process of claim 39, wherein a diluent is additionally mixed in said cooling fluid.

41. The process of claim 39, wherein a surface tension reducing agent is additionally mixed in said cooling fluid.

42. A process for cooling cutting tools and workpieces for metal cutting operations comprising the steps of:

mixing from about 25% by weight to about 35% by weight of a compound of the formula $C_6H_4(OH)$-COOR, where R is selected from the group consisting of —H, —$CH_3$, —$C_3H_7$, and —$C_4H_9$, from about 45% by weight to about 65% by weight of a ketone selected from the group consisting of camphor, methyl ethyl ketone, methyl propyl ketone, methyl isopropyl ketone, diethyl ketone, benzoin and phenylacetophenone, and from about 10% by weight to about 20% by weight of an at least partially soluble acid selected from the groups consisting of methanol, ethanol, propanol, isopropyl alcohol and butanol, said mixture being a cooling fluid;

maintaining substantial contact between said cooling fluid and an amount of a transition metal or alloy containing at least one transition metal, sufficient to catalyze a reaction within said fluid during cutting; and operating a cutting bit while maintaining substantial contact between said cutting bit and said fluid during cutting.

43. The process of claim 42, wherein a diluent is additionally mixed in said cooling fluid.

44. The process of claim 42, wherein a surface tension reducing agent is additionally mixed in said cooling fluid.

45. A process for cooling cutting tools and workpieces for metal cutting operations comprising the steps of:

mixing from about 25% by weight to about 35% by weight of methyl salicylate, from about 45% by weight to about 65% by weight of camphor, and from about 10% by weight to about 20% by weight of methanol, said mixture being a cooling fluid;

maintaining substantial contact between said cooling fluid and an amount of a transition metal or alloy containing at least one transition metal, sufficient to catalyze a reaction within said fluid during cutting; and operating a cutting tool while maintaining substantial contact between said cutting tool and said fluid during cutting.

46. A process for cooling cutting tools and workpieces for metal cutting operations comprising the steps of:

mixing from about 25% by weight to about 35% by weight of methyl salicylate from about 45% by weight to about 65% by weight of camphor, from about 10% by weight to about 20% by weight of methanol and from about 5% by weight to about 15% by weight of turpentine, said mixture being a cooling fluid;

maintaining substantial contact between said cooling fluid and an amount of a transition metal or alloy containing at least one transition metal, sufficient to catalyze a reaction within said fluid during fabrication; and operating a cutting tool which contains an amount of a transition metal or alloy containing at least one transition metal, sufficient to catalyze a reaction within said fluid while maintaining substantial contact between said cutting tool and said fluid during cutting.

47. The process of claim 46, wherein a diluent is additionally mixed in said cooling fluid.

48. A process for cooling cutting tools and workpieces of exotic metals for metal cutting operations comprising the steps of:

mixing from about 25% by weight to about 35% by weight of methyl salicylate from about 45% by weight to about 65% by weight of camphor, from about 10% by weight to about 20% by weight of methanol and from about 5% by weight to about 15% by weight of turpentine, said mixture being a cooling fluid;

maintaining substantial contact between said cooling fluid and an amount of a transition metal or alloy containing at least one transition metal, sufficient to catalyze a reaction within said fluid during cutting; and operating a cutting tool against a workpiece while maintaining substantial contact between said cutting tool and said fluid during cutting, where said workpiece at least partially comprises an exotic metal.

* * * * *